United States Patent [19]

Nakano

[11] Patent Number: 5,077,158

[45] Date of Patent: Dec. 31, 1991

[54] ELECTROPHOTOGRAPHIC IMAGE-FORMING PROCESS USING GREY TONER

[75] Inventor: Tetsuya Nakano, Nabari, Japan

[73] Assignee: Mita Industrial Co., Ltd., Osaka, Japan

[21] Appl. No.: 515,712

[22] Filed: Apr. 27, 1990

[30] Foreign Application Priority Data

Apr. 28, 1989 [JP] Japan ..... 1-107328

[51] Int. Cl.[5] ..... G03G 13/09

[52] U.S. Cl. ..... 430/45; 430/103; 430/106; 430/109; 430/122

[58] Field of Search ..... 430/45, 103, 106, 109, 430/122

[56] References Cited

U.S. PATENT DOCUMENTS 3,013,890 12/1961 Bixby ..... 430/45

3,060,021 10/1962 Greig ..... 430/45

*Primary Examiner*—David Welsh

*Attorney, Agent, or Firm*—Sherman and Shallowy

[57] ABSTRACT

In forming an image by developing an electrostatic latent image with a grey toner, a mixture of a white toner and a black toner is used as the grey toner and the ratio (D) of the black toner to the entire toner, the developing voltage (DV) and the image density (ID) are set so that the requirement represented by the following formula is satisfied:

$$ID = A_2 \times (1 - e^{-K_2 D}) \times (1 - e^{-K_3 DV})$$

wherein $A_2$ is a number of from 0.5 to 2.5, $K_2$ is a number of from 1 to 2, and $K_3$ is a number of from 0.001 to 0.01.

According to this process, a copy having a grey image area corresponding precisely to the image of an original is obtained.

7 Claims, 7 Drawing Sheets

IMAGE DENSITY (ID) vs CONCENTRATION RATIO (D) OF BLACK TONER TO ENTIRE TONER

FIG.3-A
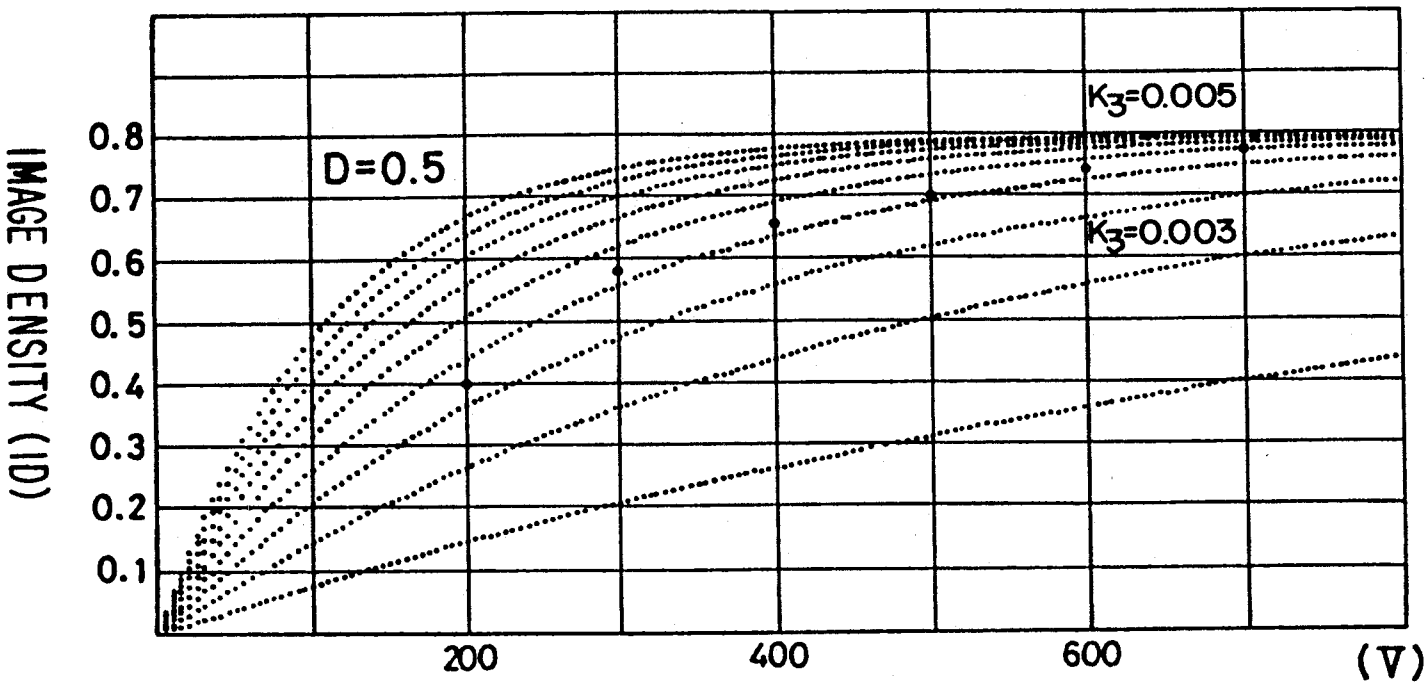
IMAGE DENSITY (ID) vs DEVELOPING VOLTAGE (SP-BIAS VOLTAGE)

FIG.3B-1
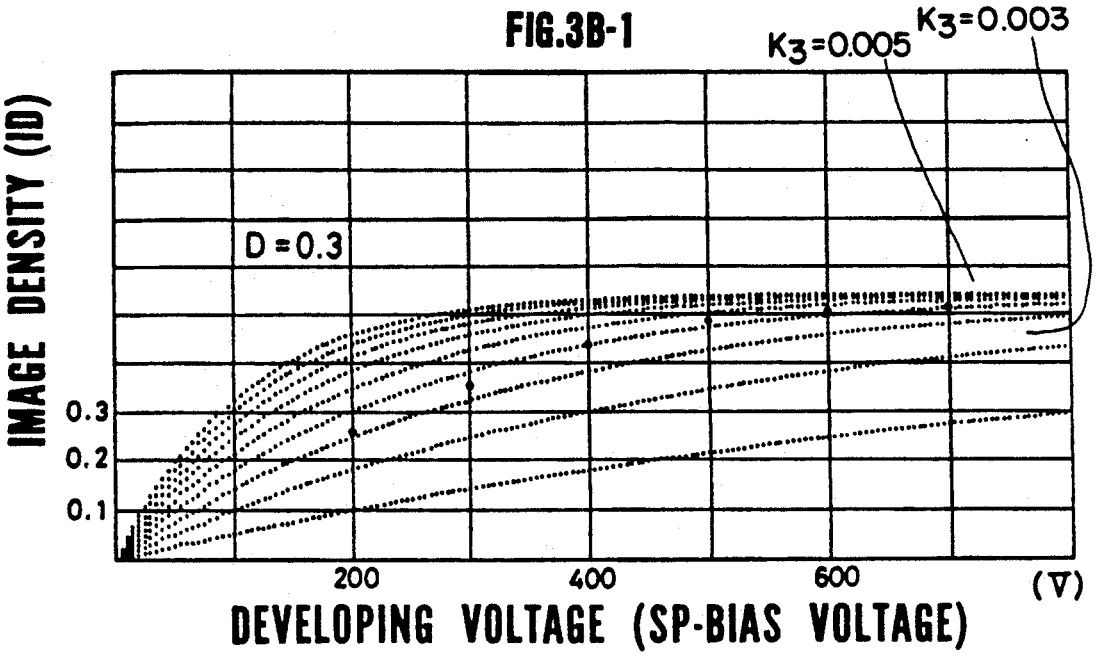
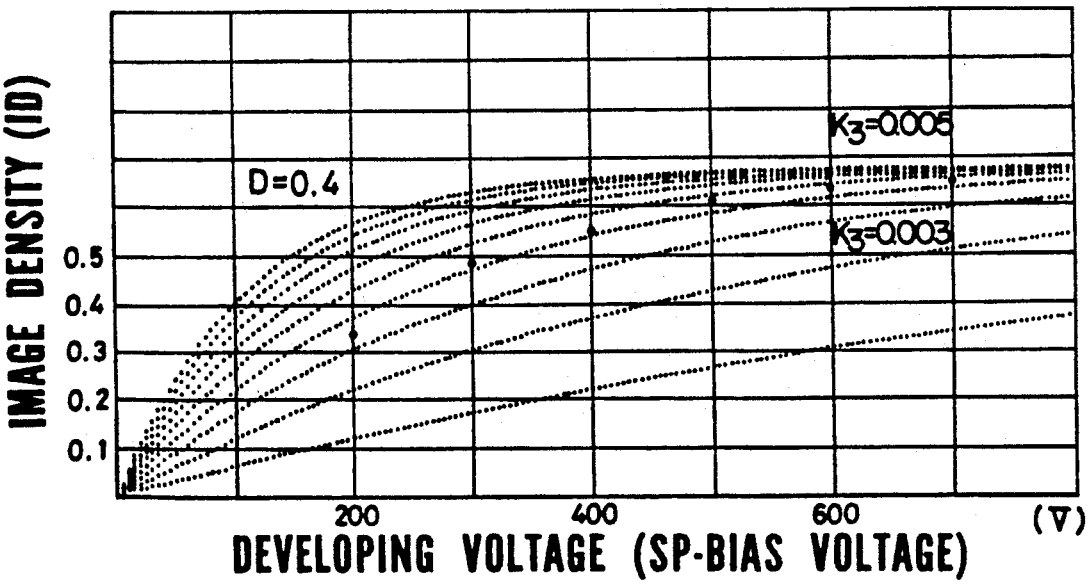
FIG.3B-2

FIG.3C-1
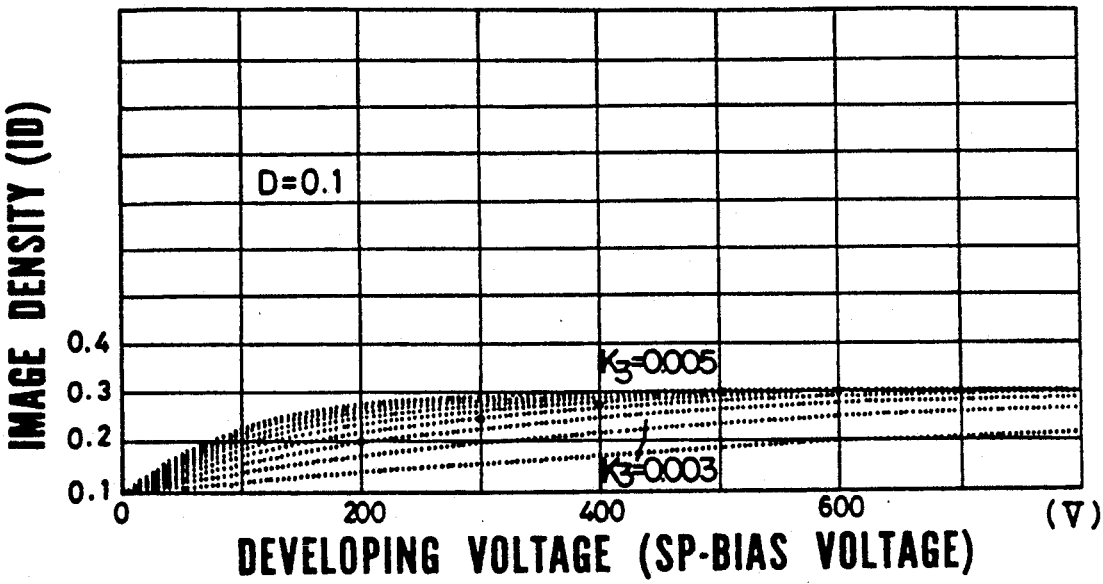
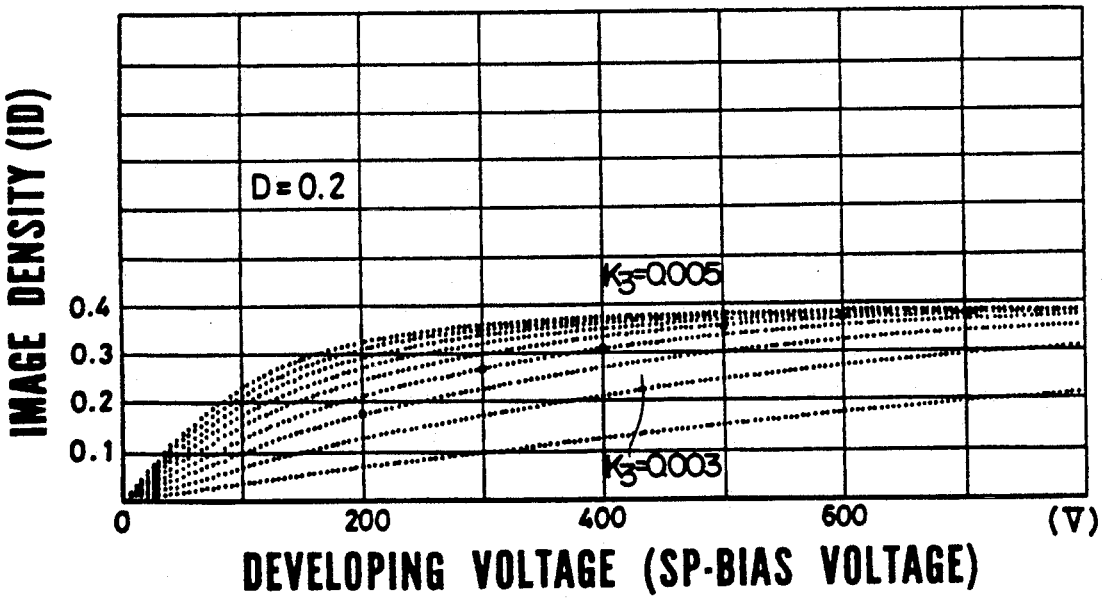
FIG.3C-2

ELECTROPHOTOGRAPHIC IMAGE-FORMING PROCESS USING GREY TONER

BACKGROUND OF THE INVENTION (1) Field of the Invention

The present invention relates to an image-forming process for obtaining prints having a grey image. More particularly, the present invention relates to an image-forming process for obtaining a desired grey-scale image from an optional original.

(2) Description of the Related Art

A process for forming prints differing in the image gradation by developing electrostatic latent images by using mixtures of a plurality of toners differing in the color is know.

For, example, Japanese Unexamined Patent Publication No. 52-147444 discloses a process in which an electrostatic latent image is developed with a toner mixture comprising at least two toners of the same polarity but different in the color, in which the difference of the triboelectric charge quantity to a carrier between the toners is 0 to 10 $\mu c/g$. In this patent publication, it is taught that not only fundamental color toners but also a black toner, a white toner and a colorless toner can be used as the toners of different colors.

According to this prior art technique, the density or chroma of the color of the reproduced image can be changed by using a mixture of a plurality of toners but it is not clarified how the mixing ratio of the toners and the developing conditions should be set for obtaining a predetermined image density from a certain original. Namely, mutual relations among these factors are not clarified in the above-mentioned patent publication.

In Japan, letters and documents concerning funerals and the like are generally prepared by using a grey ink stick or a grey ink. When such a letter or document is copied according to the conventional copying process, a print having a black image quite different from the grey scale of the original is obtained.

SUMMARY OF THE INVENTION it is a primary object of the present invention to provide an image-forming process in which an image of a desired grey scale can be obtained from an optional original.

Another object of the present invention is to provide an image-forming process in which a grey copy having a desired image density can be obtained by using a mixture of a white toner and a black toner and adjusting the ratio of the black toner to the entire toner according to the original density or the developing voltage.

More specifically, in accordance with the present invention, there is provided a process for forming an image, which comprises developing an electrostatic latent image with a grey toner, wherein a mixture of a white toner and a black toner is used as the grey toner and the ratio (D) of the black toner to the entire toner, the developing voltage (DV) and the image density (ID) are set so that the requirement represent by the following formula is satisfied:

$$ID=A_2\times(1-e^{-K_2D})\times(1-e^{-K_3DV}) \quad (1)$$

wherein $A_2$ is a number of from 0.5 to 2.5, $K_2$ is a number of from 1 to 2, and $K_3$ is a number of from 0.001 to 0.01.

Furthermore, in accordance with the present invention, there is provided a process for forming an image, which comprises developing an electrostatic latent image with a grey toner, wherein a mixture of a white toner and a black toner is used as the grey toner, and the ratio (D) of the toner to the entire toner, the original density (OD) and the image density (ID) are set so that the requirement represented by the following formula is satisfied:

$$ID=A_2\times(1-e^{-K_2D})\times(1-e^{-K_3DV}) \quad (1)$$

wherein DV is represented by formula (2) of $DV=A_1\times(1-e^{-K_1OD})-B$, $A_1$ is a number of from 400 to 1000, $A_2$ is a number of from 0.5 to 2.5, $K_1$ is a number of from 0.5 to 5, $K_2$ is a number of from 1 to 2, $K_3$ is a number of from 0.001 to 0.01, and B represents the developing bias voltage (V).

BRIEF DESCRIPTION OF THE DRAWINGS

FIGS. 3-A, 3B[1] and 3B[2] and 3C[1] and 3C[2] show the relation between the developing voltage and the image density, observed when the concentration of the black toner is changed.

DETAILED DESCRIPTION OF THE PREFERRED EMBODIMENTS

In the present invention, a mixture of a white toner and a black toner is used as the grey toner, and a certain relation represented by the formula (1) or the formulae (1) and (2) should be established among the developing voltage (DV) or original density (OD), the ratio (D) of the black toner and the final image density (ID). Namely, if the ratio of the black toner to the entire toner is set according to the original density for the developing voltage, a grey copy having a desired image density can be obtained.

The reason why the developing voltage (DV) or the original density (OD) is adopted as the fundamental factor for the development in the present invention is as described below.

Namely, the following relation is established between the surface potential (SP, volts) of a photosensitive material and the original density (OD, optical density):

$$SP=A_1\times(1-e^{-K_1OD}) \quad (3)$$

Figure 1:
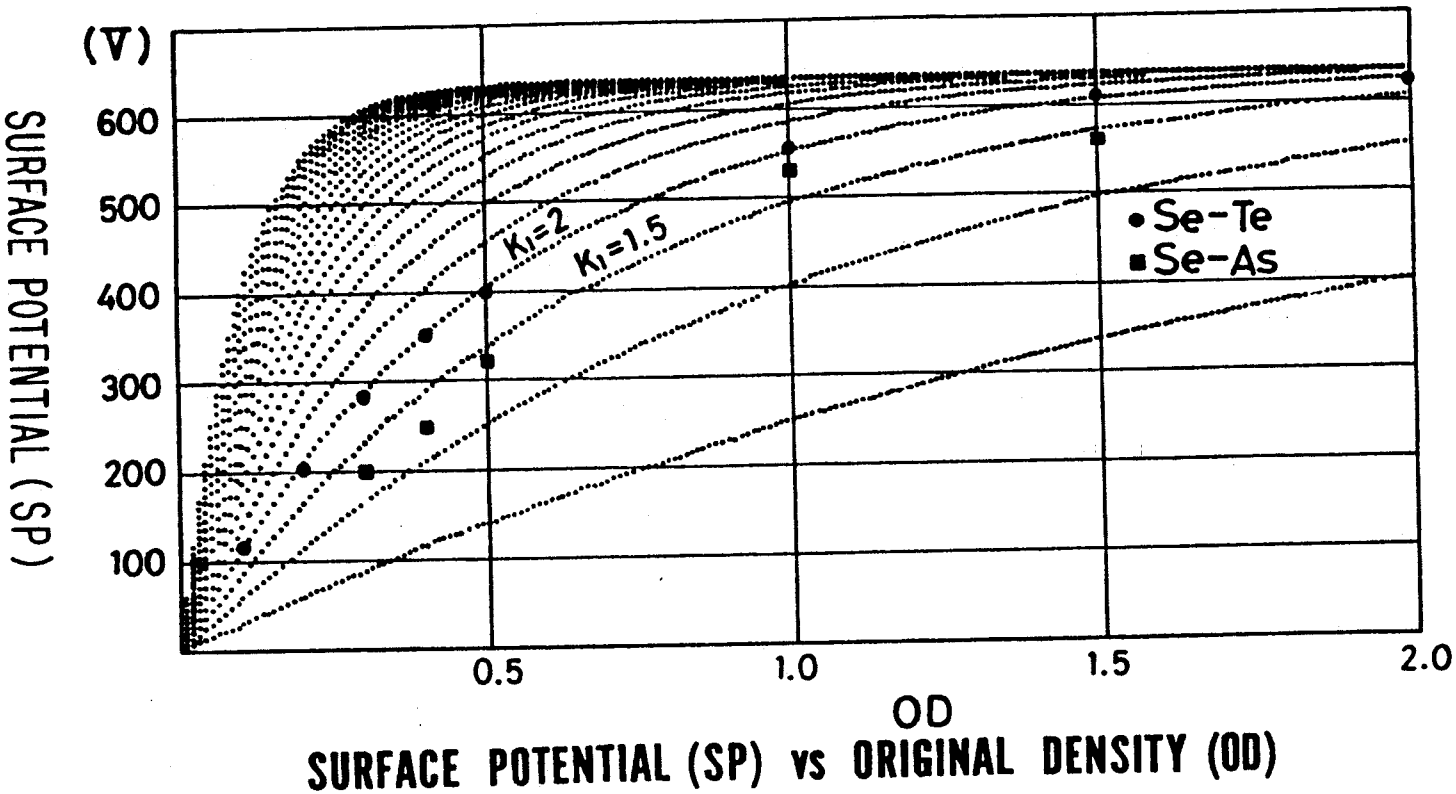
FIG. 1 is a diagram illustrating the relation between the surface potential (SP) and the original density (OD).

The relation between SP and OD is plotted on FIG. 1 of the accompanying drawings. In FIG. 1, black dots represent experimental data obtained with respect to an Se-Te type photosensitive material, and it will be understood that these experimental data are well in agreement with a curve of $K_1=2$. Furthermore, in FIG. 1, black squares represent experimental data obtained with respect to an Se-As type photosensitive material, and it will be understood that these data are on a curve of $K_1=1.5$.

In formula (3), $A_1$ is a constant having generally a value of 400 to 1000 and especially a value of 600 to 800, which corresponds to the initial saturation voltage (volts) of the photosensitive material. $K_1$ is a constant determined by the kind of the photosensitive material, and has generally a value of 0.5 to 5 and especially a value of 1 to 3.

Since the following relation is established between the developing voltage (DV, volts) and the surface potential SP:

$$DV=SP-B \quad (4)$$

wherein B represents the developing bias voltage (volts), the following formula (2) can be derived from the formulae (3) and (4):

$$DV=A_1\times(1-e^{-K_1OD})-B \quad (?)$$

The concentration ratio (D) in the black-white toner is represented by the following formula:

$$D=\frac{W_B}{W_H+W_B} \quad (5)$$

wherein $W_H$ represents the content of the white toner and $W_B$ represents the content of the black toner.

The image density (ID) is influenced not only by the concentration ratio (D) of the black toner to the entire toner but also by the developing voltage (DV). Supposing that the developing voltage is at its maximum, the following relation is established between the image density and the concentration ratio (D):

$$ID=A_2\times(1-e^{-K_2D}) \quad (6)$$

In the above formula, $A_2$ is a constant corresponding to the image density, which has generally a value of 0.5 to 2.5 and especially a value of 1.5 to 2.5, and $K_2$ is an experimentally determined number, which is generally 1 to 2 and especially 1.25 to 1.75.

Figure 2:
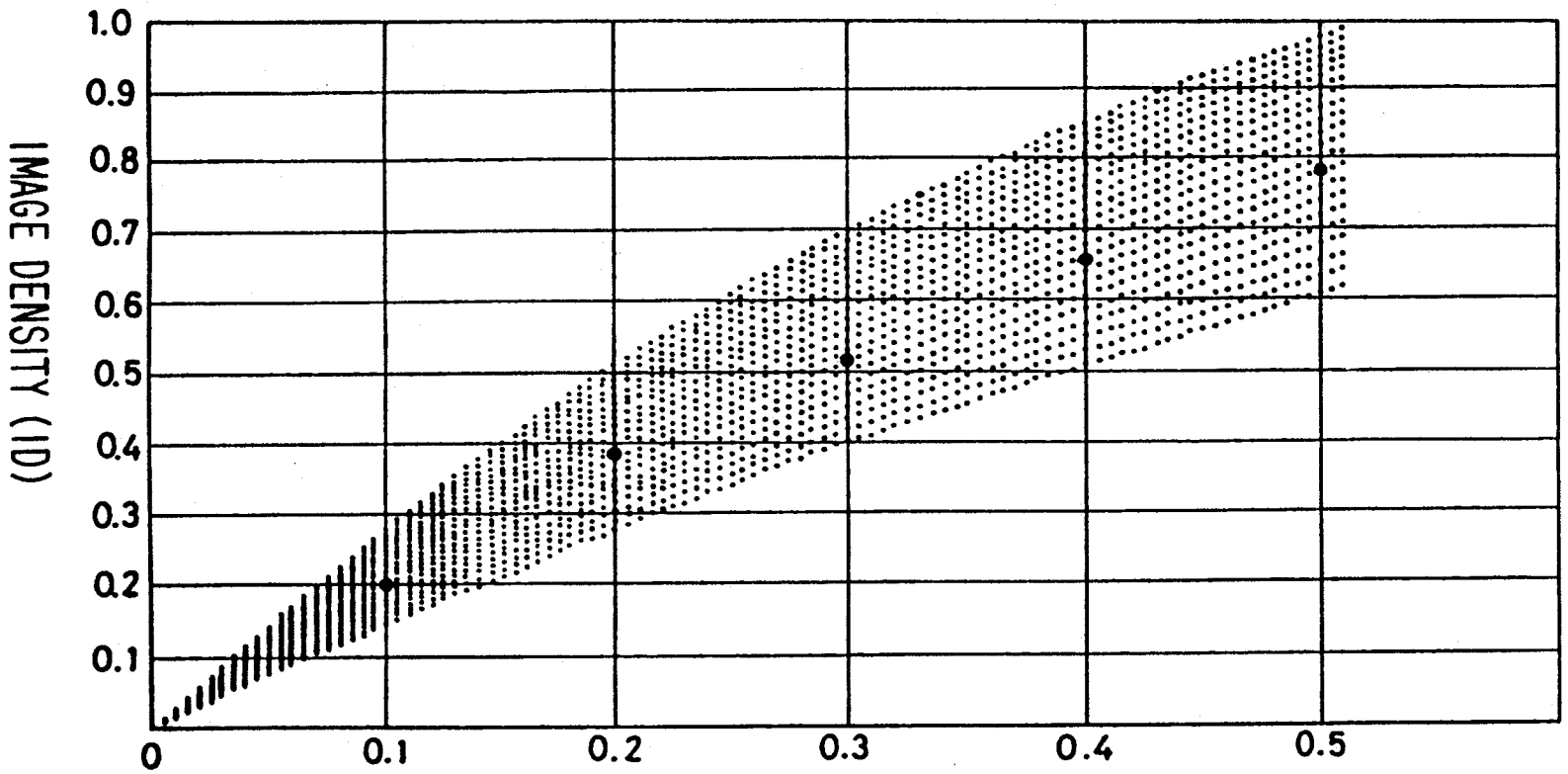
FIG. 2 is a diagram illustrating the relation between the image density (ID) and the concentration ratio of the black toner to the entire toner.

FIG. 2 is a graph illustrating the relation between ID and D. In FIG. 2, black dots represent experimental data obtained when D is changed while setting DV at 900 volts and $A_2$ at 1.55. From FIG. 2, it is seen that these experimental data are well in agreement with a curve of $K_2=1.45$.

By introducing the influence of the developing voltage (DV) into the formula (6), the following formula is derived:

$$ID=A_2\times(1-e^{-K_2D})\times(1-e^{-K_3DV}) \quad (1)$$

In the above formula, $K_3$ is an experimentally determined coefficient, which has generally a value of 0.001 to 0.01 and especially a value of 0.003 to 0.005.

FIGS. 3-A, $3B^1$ and $3B^2$ and $3C^1$ and $3C^2$ are graphs showing the relations between DV and ID, observed when D is 0.5, 0.4, 0.3, 0.2 or 0.1. In the drawings, black dots represent experimental data, and these data are well in agreement with curves of $K_3=0.003$ to 0.005.

As is apparent from the foregoing illustration, according to the present invention, a copy having a desired image density or grey scale can be obtained by adjusting the concentration ratio of the black toner to the entire toner according to the original density or developing voltage. Furthermore, it will be understood that if the original density or developing voltage is appropriately set while keeping the concentration ratio in the toner constant, a copy having a desired image density can be obtained.

Figure 4:
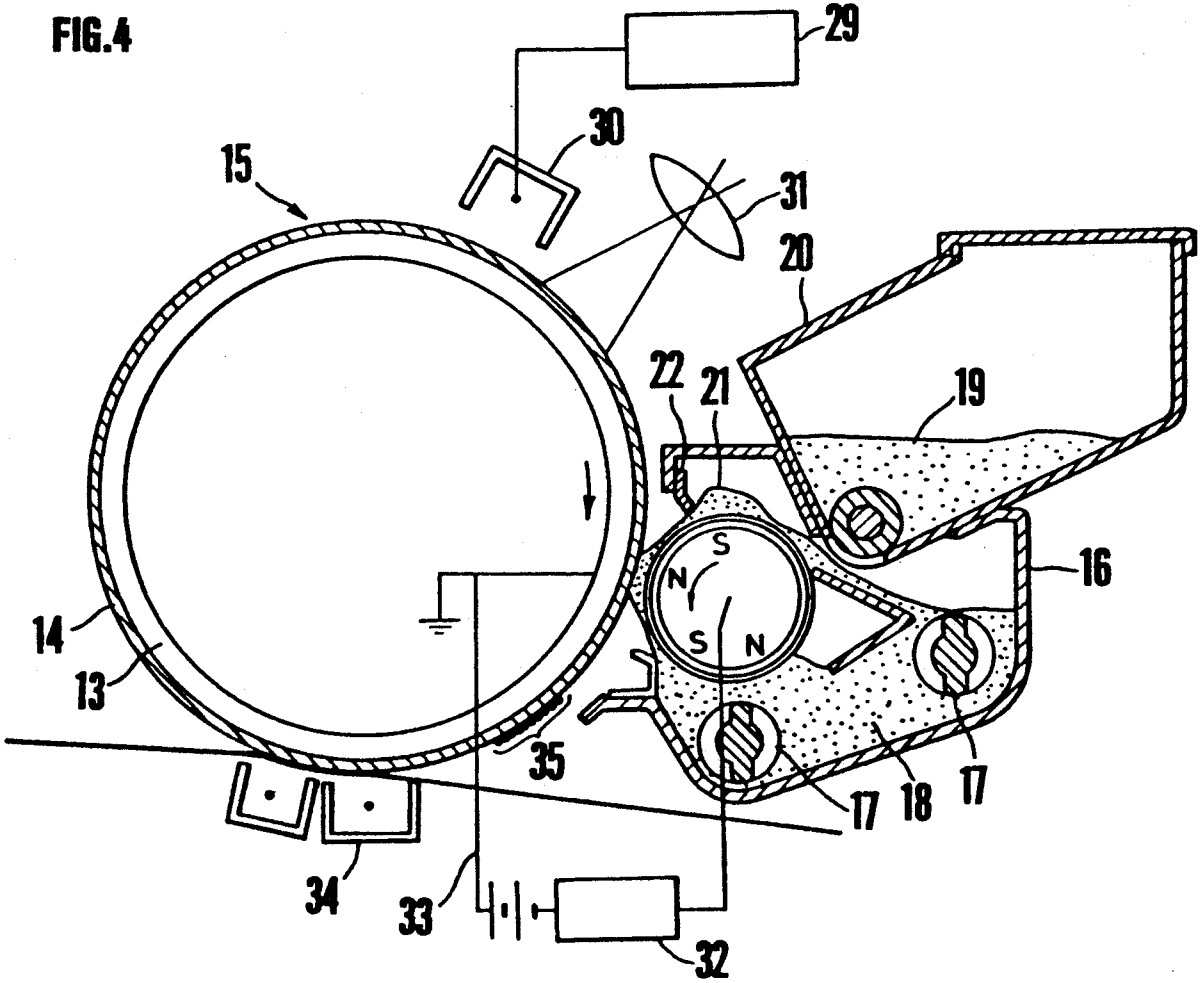
FIGS. 4 and 5 show examples of the developing apparatus used for carrying out the image-forming process of the present invention.

Referring to FIG. 4 illustrating the developing method adopted in the present invention, a magnet roll having many magnetic poles N and S is contained in a developing sleeve 12 formed of a nonmagnetic material such as aluminum, and a photosensitive drum 15 comprising a substrate 13 and an electrophotographic photosensitive layer 14 formed thereon is arranged with a minute clearance of distance $d_{D-S}$ from the developing sleeve 12. The developing sleeve 12 and photosensitive drum 15 are rotatably supported on a machine frame (not shown), and they are driven so that they move in the same direction (indicated by arrows) at the nip position (the rotation directions are reverse to each other). The developing sleeve 12 is located at an opening of a developing device 16, and a mixing stirrer 17 fot a two-component type developer 18 for a grey color (that is, a mixture of a white/black toner and a magnetic carrier) is arranged within the developing device 16, and a toner supply mechanism 20 for supplying a toner 19 is arranged above the mixing stirrer 17.

Figure 5:
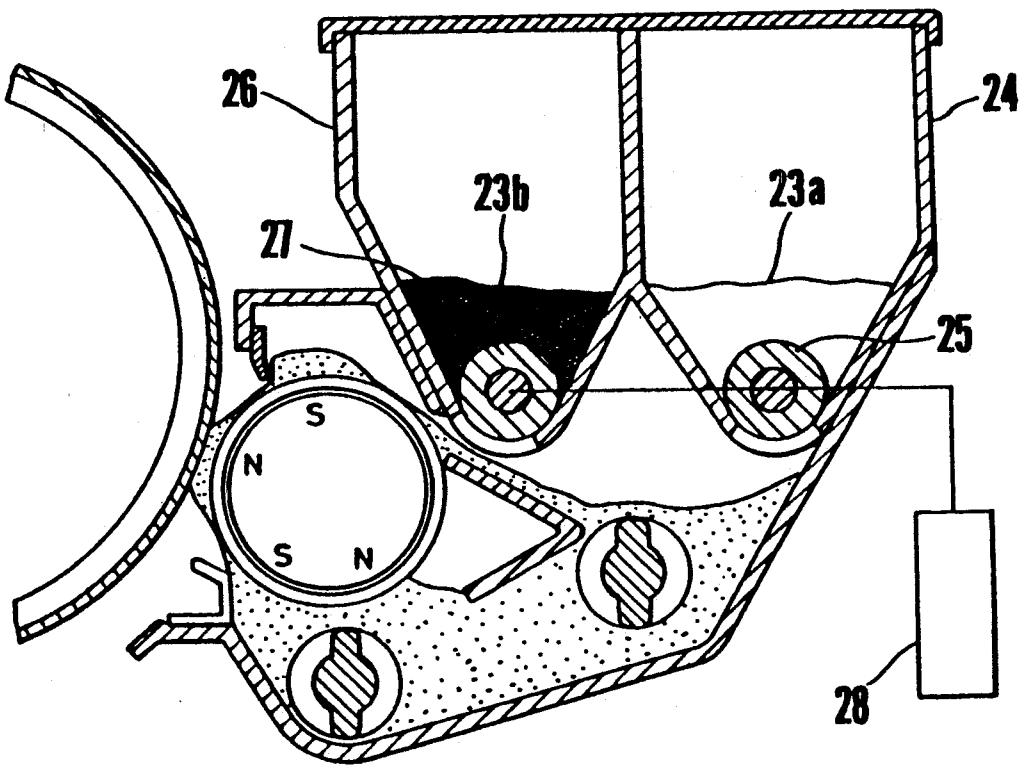

As shown in FIG. 4, the toner supply mechanism 20 may comprise a tank for storing therein a mixture 23 comprising a white toner and a black toner at a predetermined mixing ratio. Alternately, the toner supply mechanism 20 may comprise a tank 24 for storing a 20 white toner **23*a* alone, a feeder 25 for the white toner 23*a*, a tank 26 for storing a black toner 23*b* and a feeder 27 for the black toner 23*b*, as shown in FIG. 5. In the embodiment shown in FIG. 5, the feed ratio between the black and white toners is set at a predetermined value by the feeders 25 and 27, and a control mechanism 28 is arranged to control the operations of the feeders 25 and 27** according to this set value.

Around the photosensitive layer 14, a corona 30 charger 30 connected to a variable high-voltage power source 29 and an optical system 31 for the light exposure are arranged upstream of the above-mentioned developing zone to form an electrostatic latent image having a predetermined surface potential. A bias power source 33 provided with a voltage-adjusting mechanism 32 is connected between the electroconductive substrate 13 and developing sleeve 12 of the photosensitive drum to apply a bias voltage having the same polarity as that of the surface potential of the photosensitive layer 14 and an optional voltage value lower than that of the surface potential. Furthermore, a transfer mechanism 34 for transferring a toner image onto a copying sheet is arranged around the photosensitive layer 14 downstream of the developing zone.

The two-component type developer 18 comprising a white/black toner (grey toner) is mixed by the stirrer 17 to generate a triboelectric charge on the toner, and then, the toner is supplied to the developing sleeve 12 to form a magnetic brush 21 on the surface of the developing sleeve 12. The length of the magnetic brush 21 is adjusted by a brush-cutting mechanism 22, and the magnetic brush 21 is delivered to the nip position to the electrophotographic photosensitive layer 14 to develop the electrostatic latent image on the photosensitive layer 14 with the white/black toner 19 to form a grey visible image 35.

In the present invention, the adjustment of the image density (grey scale) of the grey visible image 35 is performed by the following means.

(i) The mixing ratio (D) between the white toner **23*a* and black toner 23*b*** is adjusted.

(ii) The image density (OD) of the original to be used for the light exposure is adjusted.

(iii) The light exposure quantity on the photosensitive layer 14 by the optical system 31 for the light exposure is adjusted for attaining the same effect as in (ii) above.

(iv) The developing voltage (DV) is adjusted by adjusting the surface potential (SP) by the charger 30 or adjusting the bias voltage (B) from the power source 33.

These means (i) through (iv) can be singly adopted, or two or more of these means can be adopted in combination. Furthermore, the adjustments (i) through (iv) or (ii) through (iv) can be controlled by a computer according to known procedures so that the requirements represented by the above-mentioned formulae (1) and (2) are satisfied. Especially, the adjustment (i) is performed when the toner is marketed and the adjustments (ii) through (iv) are performed by control means attached to the copying machine.

The white/black toner used in the present invention is formed by incorporating a white pigment or black pigment, a charge-controlling agent and, if necessary, other known toner additives into a binder resin medium.

A styrene resin, an acrylic resin and a styrene/acrylic copolymer resin are generally used as the binder resin medium. As the styrene monomer used for the binder resin, there can be mentioned monomers represented by the following formula:

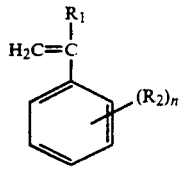

(7)

wherein $R_1$ represents a hydrogen atom, a lower alkyl group (having up to 4 carbon atoms), or a halogen atom, $R_2$ represents a substituent such as a lower alkyl group or a halogen atom, and n is an integer of up to 2, including zero, such as styrene, vinyltoluene, α-methylstyrene, α-chlorostyrene and vinylxylene, and vinylnaphthalene. Among them, styrene is preferably used.

As the acrylic monomer, there can be mentioned monomers represented by the following formula:

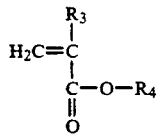

(8)

wherein $R_3$ represents a hydrogen atom or a lower alkyl group, and $R_4$ represents a hydrogen atom or an alkyl group having up to 18 carbon atoms, such as ethyl acrylate, methyl methacrylate, butyl acrylate, butyl methacrylate, 2-ethylhexyl acrylate, 2-ethylhexyl methacrylate, acrylic acid and methacrylic acid. Furthermore, other ethylenically unsaturated carboxylic acids and anhydrides thereof such as maleic anhydride, fumaric acid, maleic acid, crotonic acid and itaconic acid can be used as the acrylic monomer.

The styrene/acrylic copolymer resin is one of preferred binder resins, and the weight ratio (A)/(B) of the styrene monomer (A) to the acrylic monomer (B) is preferably in the range of from 50/50 to 90/10 and especially preferably in the range of from 60/40 to 85/15. It is generally preferred that the acid value of the resin used be from 5 to 15. Furthermore, from the viewpoint of the fixing property, it is preferred that the glass transition temperature (Tg) of the resin used be 55° to 65° C.

Known black pigments such as furnace black, channel black and other carbon blacks can be optionally used as the colorant for the black toner. This colorant is used in an amount of 5 to 15 parts by weight, especially 8 to 12 parts by weight, per 100 parts by weight of the binder resin.

Known white pigments such as titanium oxide, zinc oxide, antimony oxide, tin oxide, zirconium oxide, zinc sulfide, barium sulfate and lithopone can be optionally used as the colorant for the white toner. Among them, titanium oxide, especially titanium oxide having a rutile crystal structure, is preferably used.

The white pigment is used in an amount of 1 to 50 parts by weight, especially 2 to 30 parts by weight, per 100 parts by weight of the binder resin.

If a blue colorant is incorporated with the white pigment, a yellowish color found in the toner per se, which is due to the pigment or resin, can be corrected to a white color. A blue colorant of either the pigment type or the dye type can be used. As the blue pigment, there can be mentioned, for example, Prussian blue, cobalt blue, Alkali Blue lake, Victoria Blue lake, Phthalocyanine Blue, metal-free Phthalocyanine Blue, partially chlorinated Phthalocyanine Blue, Fast Sky Blue and Indanthrene Blue BC. As the blue dye, there can be mentioned Methylene Blue and Ultramarine Blue.

The blue colorant is used in an amount of up to 5 parts by weight, especially 0.001 to 2 parts by weight, per 100 parts by weight of the binder resin.

Of course, a coloring pigment or dye other than the blue colorant can be incorporated into the white toner to give a light color to the white toner.

Charge-controlling agents can be incorporated into the white/black toner. For controlling the positive charge, there can be used, for example, organic compounds having a basic nitrogen atom, such as a basic dye, aminopyrin, a pyrimidine compound, a polynuclear polyamino compound and an aminosilane, and fillers surface-treated with these compounds. For controlling the negative charge there can be used, for example, carboxyl group-containing compounds such as metal chelates of alkyl salicylates. The charge-controlling agent is preferably used in an amount of 1 to 10% by weight based on the toner. In the method in which the toner is fixed by a hot roll, an offset-preventing agent such as a silicone oil, a low-molecular-weight olefin resin or a wax can be used in an amount of 2 to 15% by weight. In the case where the toner is fixed by a pressure roll, a pressure fixability-imparting agent such as paraffin wax, an animal or vegetable wax or a fatty acid amide can be used in an amount of 5 to 30% by weight based on the entire toner.

In the present invention, a dispersion of a white pigment or black pigment in a binder resin medium is shaped into particles having a particle size of 5 to 50 μm, whereby a toner is prepared.

The preparation of the toner can be performed by known optional means. For example, a toner is prepared by incorporating the above-mentioned pigment and charge-controlling agent, together with other additives according to need, into the binder resin medium, kneading the mixture uniformly and homogeneously and shaping the kneaded mixture into particles. The particles are obtained by cooling the kneaded mixture, pulverizing the mixture and, if necessary, sieving the pulverization product. Of course, mechanical rapid stirring can be performed for rounding the corners of particles having an indeterminate shape.

According to another process, a toner composed of spherical particles can be obtained by dissolving the binder resin in a solvent such as toluene or xylene, dispersing the pigment into the solution and subjecting the dispersion to spray-drying granulation.

Furthermore, a toner can be obtained by dispersion a white pigment or black pigment in a solvent capable of dissolving a monomer therein but incapable of dissolving a polymer formed from the monomer and polymerizing the monomer in the pigment dispersion in the presence of a radical initiator. Monomers as mentioned above are preferably used as the monomer.

It is preferred that the white toner and black toner used in the present invention be akin to each other in the electric characteristics.

It is preferred that the conductivity, as measured by using a parallel plate type electrode, of the white/black toner used in the present invention be $1\times10^{-8}$ to $9\times10^{-12}$ s/cm, especially $1\times10^{-10}$ to $9\times10^{-10}$ s/cm, and that the dielectric constant of the white/black toner be 2 to 4, especially 2.5 to 3. It also is preferred that the triboelectric charge quantity of the white/black toner be 10 to 40 μc/g, especially 15 to 25 μc/g The mixing ratio between the white toner and black toner, that is, the above-mentioned concentration ratio (D), is preferably 0.01 to 0.5, especially preferably 0.2 to 0.4.

The magnetic carrier used in the present invention has a saturation magnetization of 40 to 60 emu/g, preferably 45 to 55 emu/g. It is preferred that the volume resistivity of the magnetic carrier be $10^7$ to $10^{14}$ Ω-cm, especially $10^9$ to $10^{12}$ Ω-cm. A ferrite carrier, especially a spherical ferrite carrier, satisfying the above conditions is preferably used as the magnetic carrier. It is preferred that the particle size of the ferrite carrier be 50 to 200 μm, especially 60 to 100 μm.

For example, sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) have been used as the ferrite. Especially, soft ferrites containing at least one metal component, preferably at least two metal components, selected from the group consisting of Cu, Zn, Mg, Mn and Ni, for example, copper/zinc/magnesium ferrite, have been used. In the present invention, among these ferrites, those satisfying the above-mentioned conditions are selected and used.

The magnetic characteristics, dielectric constant and electric resistance of the ferrite vary according to the chemical composition, but furthermore, these properties vary according to the particle size, particle structure, preparation process, surface coating and the like, and they depend especially on the sintering temperature and sintering time. At least one member selected from the group consisting of silicone resins, fluorine resins, acrylic resins, styrene resins, styrene/acrylic resins, olefin resins, ketone resins, phenolic resins, xylene resins and diallyl phthalate resins can be used as the coating resin for the surface coating.

In the present invention, a two-component type developer comprising the white/black toner and the magnetic carrier is used for the development. The mixing ratio between the white/black toner and the magnetic toner is changed according to the physical properties of the white/black toner and magnetic carrier, but it is preferred that the toner/carrier weight ratio be from 1/100 to 20/80, especially from 5/95 to 15/85. In order to attain the objects of the present invention, it is preferred that the resistivity of the developer as a whole be $1\times10^8$ to $9\times10^{12}$ Ω-cm, especially $1\times10^{10}$ to $9\times10^{10}$ Ω-cm.

In the present invention, an electrophotographic photosensitive material having a surface potential (SP, $A_1$) of 400 to 1000 volts is used as the photosensitive material. For example, photosensitive materials of the Se type, α-Si type, OPC type, Cds type, ZuO type, $TiO_2$ type and composite type (Se/OPC laminate) can be optionally used.

It is preferred that the developing voltage (DV) be 200 to 800 volts, especially 400 to 600 volts. The developing bias voltage (B) is appropriately set according to the relation between the surface potential and the developing voltage.

In the present invention, a mixture of a white toner and a black toner is used as the grey toner and a certain relation defined by the above-mentioned formula (1) or formulae (1) and (2) is established among the developing voltage (DV) or original density (OD), the ratio (D) of the black toner to the entire toner and the final image density (ID). Therefore, for example, by appropriately setting the ratio of the black toner to the entire toner according to the original density or developing voltage, a grey print having a desired image density can be obtained.

The present invention will now be described in detail with reference to the following examples that be no means limit the scope of the invention.

EXAMPLE 1

Black Toner

A black toner having an average particle size of 12 μm was prepared by mixing and dispersing 90 parts by weight of a styrene-acrylic copolymer, 8 parts by weight of conductive carbon black, 1 part by weight of low-molecular-weight polypropylene and 1 part by weight of a negative -polarity dye, melt-kneading the mixture and pulverizing and classifying the melt-kneaded mixture according to customary procedures.

White Toner

A white toner having an average particle size of 12 μm was obtained by mixing and dispersing 80 parts by weight of a styrene/acrylic copolymer, 17 parts by weight of titanium oxide as the white pigment, 1 part by weight of low-molecular-weight polypropylene and 2 parts by weight of a negative-polarity white dye and pulverizing and classifying the mixture according to customary procedures.

With respect to the black toner and white toner, the conductivity and dielectric constant were measured. It was found that the black toner had a conductivity of $8\times10^{-10}$ s/cm and a dielectric constant of 2.8 and the white toner had a conductivity of $2\times10^{-10}$ s/cm and a dielectric constant of 3.0.

In a remodelled machine of an electrophotographic copying machine, Model DC-111 supplied by Mita Industrial Co. Ltd., a copy was formed at a developing voltage of 600 V by using a developer prepared by mixing the above-mentioned white and black toner so that the ratio (D) of the black toner was 0.5. The image density (ID) of the obtained copy was 0.74.

When $A_2$of 1.55, $K_3$ of 1.45 and $K_3$ of 0.004 were set as standard values based on experimental data, the image density became 0.727 (calculated value), which was substantially equivalent to ID of the above-obtained sample copy.

EXAMPLE 2

In the remodelled machine of DC-111, the surface potential and bias voltage were set at 830 V and 190 V, respectively. A grey toner was prepared by mixing the black and white toners used in Example 1 so that the ratio (D) of the black toner was 0.3. When a sample copy was obtained at an original density of 1.3, an image density (ID) of 0.44 was obtained.

When $A_1$ of 640, D of 0.3, OD of 1.3 and $K_1$ of 2 were adopted based on the set conditions and experimental data and $A_2$, $K_2$ and $K_2$ were set at 1.55, 1.45 and 0.004, respectively, DV or 402 and ID of 0.437 substantially equivalent to the experimental values were obtained.

I claim:

1. A process for forming an image, which comprises developing an electrostatic latent image with a grey toner, wherein a mixture of a white toner and a black toner is used as the grey toner and the ration (D) of the black toner to the entire toner, the developing voltage (DV) and the image density (ID) are set so that the requirement represented by the following formula is satisfied:

$$ID=A_2\times(1-e^{-K_2D})\times(1-e^{-K_3DV})$$

wherein $A_2$ is a number of from 0.5 to 2.5, $K_2$ is a number of from 1 to 2, $K_3$is a number of from 0.001 to 0.01.

2. A process according to claim 1, wherein the white toner is composed mainly of a white pigment and a minor amount of a coloring pigment is incorporated in the white toner.

3. A process according to claim 1, wherein the coloring pigment is a blue pigment.

4. A process according to and of claims 1 through 3, wherein the white toner and black toner have a conductivity of $1\times10^{-8}$ to $1\times10^{-12}$ s/cm as measured by using a parallel plate type electrode.

5. A process according to and of claims 1 through 3, wherein the white and black toners have a triboelectric charge quantity of 10 to 40 $\mu$c/g.

6. An image-forming process comprising developing an electrostatic latent image with a grey toner, wherein a mixture of a white toner and a black toner in which the concentration ratio (D) of the black toner to the entire toner is from 0.01 to 0.5 is used as the grey toner, and the mixed toner is used in an image-forming apparatus provide with control means for cotrolling the developing voltage (DV) and image density (IV) so that the following requirement is satisfied:

$$ID=A_2\times(1-e^{-K_2D})\times(1-e^{-K_3DV})$$

wherein $A_2$ is a number of from 0.5 to 2.5, $K_2$ is a number of from 1 to 2, $K_3$is a number of from 0.001 to 0.01.

7. A process for forming an image, which comprises developing an electrostatic latent image with a grey toner, wherein a mixture of a white toner and a black toner is used as the grey toner, and the ratio (D) of the toner to the entire toner, the original density (OD) and the image density (ID) are set so that the requirement represented by the following formula is satisfied:

$$ID=A_2\times(1-e^{-K_2D})\times(1-e^{-K_3DV})$$

wherein DV is represented by the formula of $DV=A_1\times(1-e^{-K_1OD})-B$, $A_1$ is a number of from 400 to 1000, $A_2$ is a number of from 0.5 to 2.5, $K_1$ is a number of from 0.5 to 5, $K_2$ is a number of from 1 to 2, $K_3$ is a number of from 0.001 to 0.01, and B represents the developing bias voltage (V).

* * * * *